US006131755A

United States Patent [19]

Soyka, Jr. et al.

[11] Patent Number: 6,131,755

[45] **Date of Patent: *Oct. 17, 2000**

[54] BOTTLE ASSEMBLY

[76] Inventors: Richard Joseph Soyka, Jr., 47832 Robin St., Mt. Clements, Mich. 48043-6565; Mark John Hydar, 12245 Deming, Sterling Heights, Mich. 48312

[ * ] Notice: This patent issued on a continued prosecution application filed under 37 CFR 1.53(d), and is subject to the twenty year patent term provisions of 35 U.S.C. 154(a)(2).

[21] Appl. No.: 09/277,614

[22] Filed: Mar. 26, 1999

Related U.S. Application Data

[62] Division of application No. 09/090,198, Jun. 4, 1998, Pat. No. 5,897,010.

[51] Int. Cl.[7] ..... B65D 25/20

[52] U.S. Cl. ..... 215/390; 215/382; 220/744; 220/735; 220/675

[58] Field of Search ..... 215/6, 10, 383, 215/382, 390; 222/572; 220/694, 675, 669, 212, 288, 796, 735, 744

[56] References Cited

U.S. PATENT DOCUMENTS 1,451,822 4/1923 Hagerty .
1,649,580 11/1927 Geisler .
1,755,086 4/1930 Tapp .
2,744,649 5/1956 Smith .
3,225,951 12/1965 Poston et al. .
3,814,288 6/1974 Westrich .
4,548,339 10/1985 Gorman ..... 222/129
4,573,595 3/1986 Mednis .
4,708,253 11/1987 Mednis .
4,713,064 12/1987 Bruno et al. ..... 604/257
4,765,514 8/1988 Berglund .
4,971,211 11/1990 Lake ..... 215/6
5,050,757 9/1991 Hidding et al. .
5,086,937 2/1992 Robinson .
5,211,299 5/1993 Manfredonia .
5,358,148 10/1994 Hanifl et al. ..... 222/215
5,803,268 9/1998 Levy et al. ..... 206/581

*Primary Examiner*—Stephen Castellano
*Attorney, Agent, or Firm*—Chupa & Alberti, P.C

[57] ABSTRACT

Several bottle assemblies 10, 50, 662, 70, and 80 are disclosed having a cap retention portion, respectively identified by reference numbers 28, 54, 64, 73, and 84 which are adapted to allow removable storage of bottle cap 22.

2 Claims, 3 Drawing Sheets

BOTTLE ASSEMBLY

This application is a divisional of application Ser. No. 09/090,198, filed Jun. 4, 1998, now U.S. Pat. No. 5,897,010.

1. Field of the Invention

This invention relates to a bottle assembly and more particularly, to a bottle assembly having novel bottle cap storage features and/or novel bottle cap storage characteristics.

2. Background of the Invention

Bottles are commonly used to contain a variety of beverages or other types of fluids which are adapted to be selectively accessed and consumed or drunk by "users" of these bottles. Particularly, most of these commercially available bottles are composed of plastic or plastic type materials, such as and without limitation polyethylene teraphalate or "PET", and include a removable bottle cap which allows a user to access the contained beverage or fluid, to drink or consume all or a portion of the accessed liquid material, and to thereafter selectively seal the remaining beverage from the air or outside environment, thereby ensuring that beverages such as carbonated liquids, don't become "flat" or stale. Such bottles are commonly manufactured by a variety of methods including and without limitation the method of blow molding described within U.S. Pat. No. 5,086,937 which was issued on Feb. 11, 1992 and which is fully and completely incorporated herein by reference, word for word and paragraph for paragraph. While these commercially available bottles and bottle assemblies (the combination of the bottle and the removable cap being referred to as an "assembly" throughout this Application) adequately allow the contained beverage to be stored and drunk, they suffer from a variety of drawbacks.

One of the major drawbacks associated with these bottle assemblies is that the removable cap is oftentimes misplaced, inadvertently destroyed, or placed/stored in an area where it is soiled or contaminated, thereby causing the user to either dispose of (e.g. drink) the entire remaining beverage contents, store the remaining contents without the cap in place, thereby causing the contained carbonated beverage to become stale, "flat", or contaminated by means of "outside" material, or find some other selectively sealed container with which to place the unused beverage contents within. None of these results is particularly desirable.

One attempt at overcoming these drawbacks is found within U.S. Pat. No. 5,211,229, ("the '299 patent"), issued on May 18, 1993 to Manfredonia and which is fully and completely incorporated herein by reference, word f or word and paragraph for paragraph. Particularly, the '299 patent provides for a bottom or conical cavity portion 21 formed within a bottle and including a plurality of concentrically positioned projecting members 22 which are adapted to flexibly engage a uniquely designed bottle cap 15 having an annular groove 17. Particularly, projections 21 are adapted to flexibly and selectively engage groove 17 and allow the bottle cap 15 to be removably and selectively deployed within the bottom positioned cavity 23 such that the bottle contacting portion of the cap is made to contact or rest upon the surface upon which the bottle assembly rests.

One of the major drawbacks associated with the approach described within the '299 patent is that the assembly requires the bottle cap 15 to be placed in the bottom or support portion of the bottle assembly in a manner which requires that the bottle contacting portion of the cap actually touch the surface that the bottle is placed upon, thereby becoming dirty, or contaminated. Further, such bottom placement causes cap 15 to oftentimes dislodge as the bottle is moved across a tabletop or other support surface. Such bottom placement may also causes the assembly to become unstable and "fall" or "roll over" when placed upon a surface due to the difficulty in properly securing the members 22 within groove 17 and fatigue induced elasticity of these members 22 resulting from repeated insertions of the cap within the bottle.

Moreover, the '299 patent assembly requires a uniquely or "specially" designed bottle cap 15 having an annular ring 17 which is engaged by uniquely designed projecting members 22 formed in the bottle. Hence, the '299 patent assembly is not readily useable with most of the existing bottle caps in use today (e.g. such as and without limitation those employed are most soft drink containers.) That is, most soft drink and other types of bottle caps do not have the required annular ring necessary for use in and/or with the '299 patent bottle assembly. Lastly, projections 22, over time, may become broken or lose their flexibility (e.g. suffering a degradation in their physical structure) due to repeated insertions and removals of cap 15 within cavity 21, thereby preventing the selective storage of bottle cap 15. In sum, the bottle assembly of the '299 patent has several drawbacks, including but not limited to, those which are delineated above.

There is therefore a need for a bottle assembly having an improved bottle cap retention feature which overcomes the drawbacks of the prior art and which, particularly by way of example and without limitation, allows a commonly used and commercially available type of bottle cap to be easily and removably stored when not in use, which further provides for the storage of the bottle cap in a substantially sanitized manner, and which further allows for repeated storage and removal of the bottle cap without a substantial degradation in the physical structure of the storage member. These and other needs are met by the invention(s) set forth in this Application.

SUMMARY OF THE INVENTION

According to a first aspect of the present invention a bottle assembly is provided which overcomes many of the deficiencies and disadvantages of the prior art, including but not limited to those which have been previously delineated.

According to a second aspect of the present invention a bottle assembly is provided having a bottle cap reception portion which allows the bottle cap to be selectively and removably stored in a relatively secure manner.

According to a third aspect of the present invention a bottle assembly is provided. The bottle assembly, according to this third aspect of the invention, includes a bottle cap having a generally cupped shape outer surface forming a hollow interior surface; and a bottle having a generally cylindrical outer surface forming an interior beverage containment cavity, and further having a first cap retention portion which is coaxial to the longitudinal axis of the generally cylindrical bottle and further having a second cap retention portion which protrudes away from the generally cylindrical outer surface and which is adapted to securely and removably fit within the hollow interior surface of the cap, thereby allowing the cap to be selectively and removably attached to and/or within the second cap retention portion.

According to a fourth aspect of the present invention, an alternate bottle assembly embodiment is provided which includes an outer surface depression which is adapted to removable store and secure the bottle cap.

These and other features, objects, and advantages of the present invention will become apparent by reading of the following detailed description of the invention, by reference to the attached drawings, and/or by reference to the subjoined claims included in this application for patent.

BRIEF DESCRIPTION OF THE DRAWINGS

FIG. 1 His a view of the bottle shown in FIG. 9 with cap 22 in unassembled relation with the bottle and taken in the direction of arrow 9.

DETAILED DESCRIPTION OF THE PREFERRED EMBODIMENT OF THE INVENTION

Figure 1:
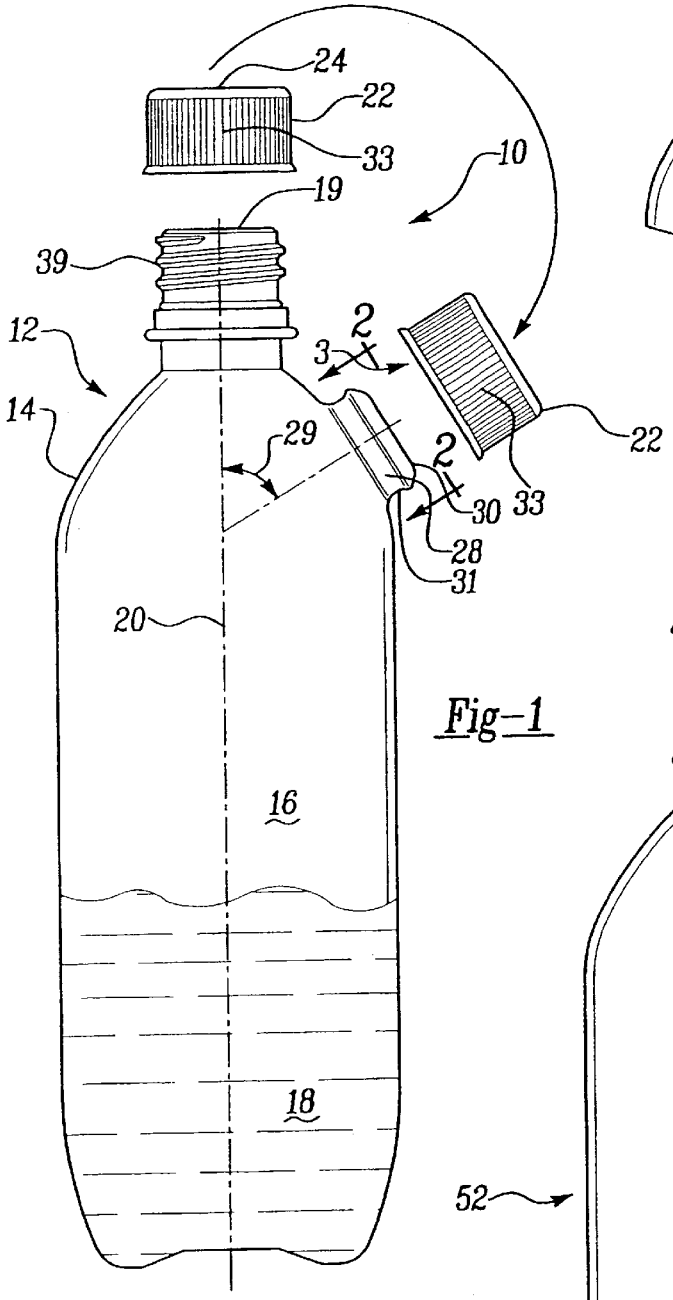
FIG. 1 is an unassembled side view of a bottle assembly made in accordance with the teachings of a first embodiment of this invention.
Figure 2:
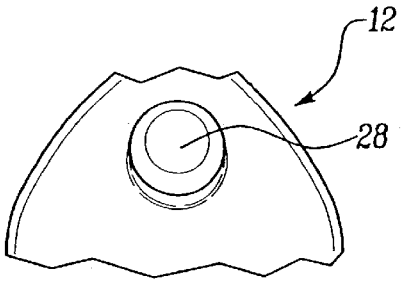
FIG. 2 is a view of FIG. 1 taken along view line 1–1'.

Referring now to FIG. 1, there is shown a bottle assembly 10 made in accordance with the teachings of a first embodiment of the invention. As shown, bottle assembly 10 includes a bottle 12, such as and without limitation a conventional and commercially available, generally plastic, sixteen ounce carbonated soda pop bottle, having a generally cylindrical outer surface 14 which forms an interior beverage and/or fluid containment cavity 16.

Interior cavity 16 is usually filled with a beverage such as and without limitation carbonated soda pop, and accessed, drunk, and/or is in communication with a user by means of a first usually threaded and open cap retention portion 19 which is usually and substantially coaxial to the longitudinal axis 20 of the generally cylindrical bottle 14. Assembly 10 further includes a cap 22 having a generally cup shaped outer surface 24, including a generally flat and closed top surface 100, and a hollow generally cylindrical or round interior open surface 26 having threaded edges 27 which are complementary to threaded edges 39 of portion 19. Edges 27 and 39 cooperatively allow cap 22 to be selectively and removably positioned upon bottle 14. As should be appreciated by those of skill in this art, other techniques may be used to place cap 22 upon bottle 14 and that the various inventions delineated within this Application are useable and applicable to these alternate assemblies.

As is further shown in FIG. 1, assembly 10 also includes a second cap retention portion 28 which, in one embodiment, is integrally formed within bottle 12, upon outer surface 14, and protrudes out and/or away from the generally cylindrical outer surface 14 and the longitudinal axis 20 at an angle 29 (e.g. formed by joining longitudinal axis 20 to the center of the outer surface 30 of portion 28) of about thirty degrees (300) with respect to the longitudinal axis 20. Other angular displacements may be used.

In this first embodiment of the invention, portion 28 includes and/or forms a generally annular ring 31 which is positioned substantially in and around the center of portion 28 and which is adapted to and cooperates with the remainder of portion 28 to securely, deformably, removably, and frictionally fit within the hollow interior surface 26 of the cap 22 (corresponding, in one embodiment, to a conventional and commercially available bottle cap such as that placed upon typical 16 ounce soft drink bottles, such as that produced by the Coca-Cola Company of Atlanta, Ga.) thereby allowing the cap 16 to be selectively and removably attached to the second cap retention portion 28. Particularly, as surface 26 is placed over portion 28, flexible annular ring portion 31 as well as entire portion 28 selectively and removably engages side portions 33 of cap 22 thereby ensuring relatively secure placement of cap 22 over portion 28

It should be apparent to those readers of this Application that the use of integrally formed outwardly protruding portion 28 allows the cap 22 to be securely and removably placed in a relatively sanitized position, allows for the repeated insertions and removal of cap 22 upon portion 28 without substantial physical deformation to portion 28 and allows conventional and commercially available bottle caps 22 to be utilized in the desired selectively stored configuration, and does not tend to cause bottle 12 to "fall over" or become destabilized when placed upon a surface. Moreover, the use of integrally formed protruding portion 28 allows for the formation of bottle 12 by means of standard and conventional PET type "blowing techniques", thereby obviating the need for a substantial change in the known bottle manufacturing techniques. All of these advantages make the disclosed bottle assembly 10 highly desirable.

Figure 4:
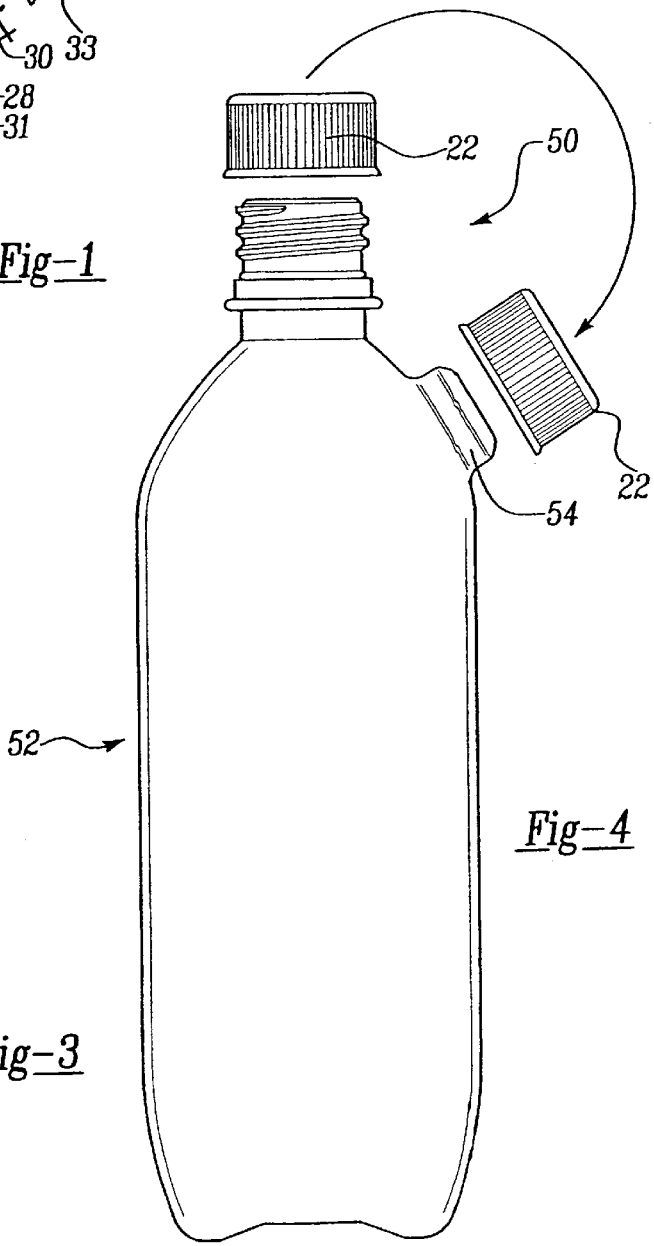
FIG. 4 is an unassembled side view of a bottle assembly made in accordance with the teachings of a second embodiment of this invention.
Figure 3:
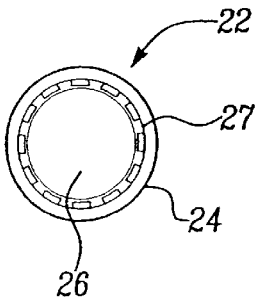
FIG. 3 is a view of the bottle cap shown in FIG. 1 and taken along and/or in the direction of arrow 3.

Referring now to FIG. 4, bottle assembly 50 made in accordance with the teachings of a second embodiment of the invention is shown, and includes a bottle cap 22 and a bottle 52 having an integrally formed outwardly protruding portion 54. Specifically, bottle assembly 50 differs from bottle assembly 10 in that the integrally formed outwardly protruding portion 54 of bottle 52 has no annular ring 31. In all other aspects, assembly 50, is substantially similar to assembly 10.

Figure 5:
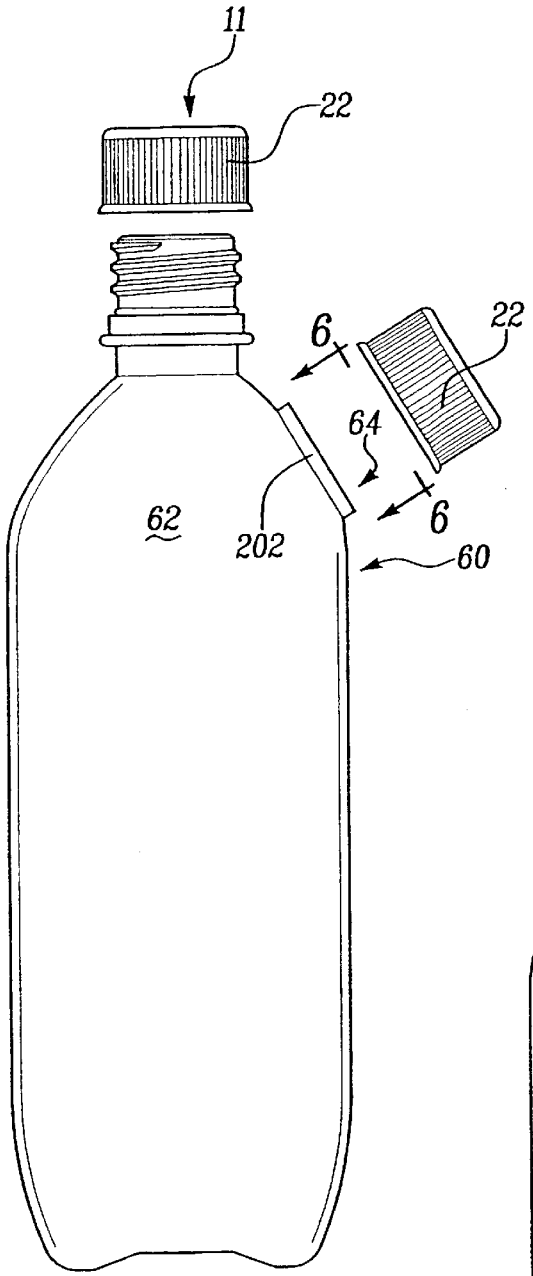
FIG. 5 is an unassembled side view of a bottle assembly made in accordance with the teachings of a third embodiment of this invention.
Figure 6:
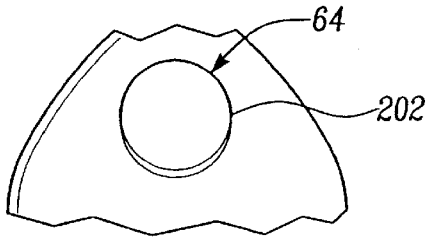
FIG. 6 is a view of FIG. 5 taken along view line 5–5'.

Referring now to FIGS. 5 and 6, bottle assembly 60, made in accordance with the teachings of a third embodiment of the invention is shown and includes a bottle cap 22 and a bottle 62 having an outwardly protruding portion 64. Specifically, bottle assembly 60 differs from assemblies 10 and 50 in that outwardly protruding portion 64 comprises an outwardly extending flexible annular ring 202 (or alternatively several flexible protruding members) integrally formed within bottle 62, protruding away from longitudinal axis 20, and adapted to flexibly and frictionally engage the interior surface 26 of cap 22 thereby securing cap 22 to the outside of bottle 62. In all other aspects, assembly 60 is substantially similar to assemblies 10 and 50. In one embodiment, ring 202 and/or the individual members extend about one quarter of an inch away from the bottle surface.

Figure 7:
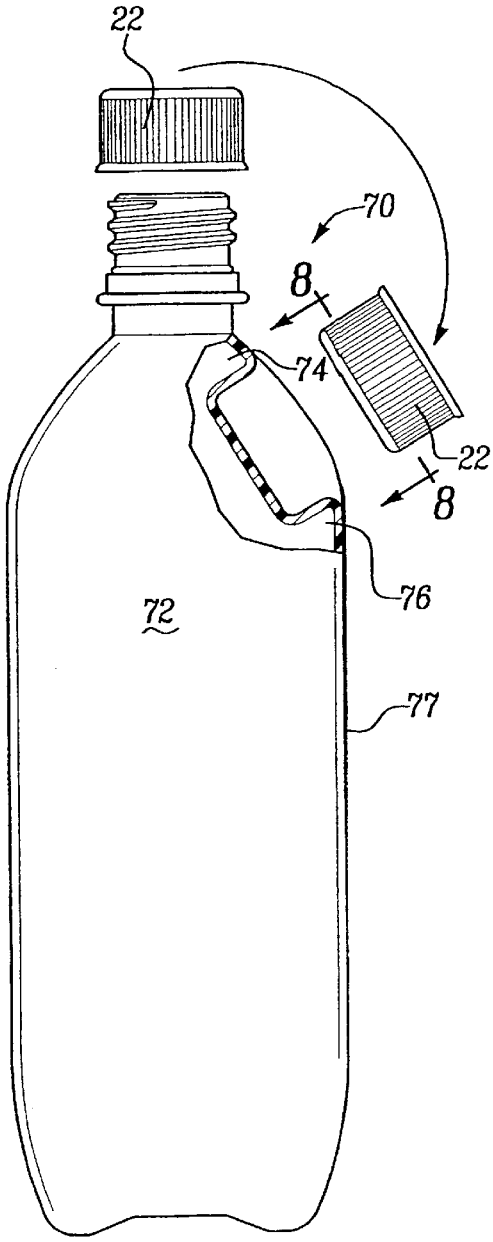
FIG. 7 is a side view of a bottle assembly made in accordance with the teachings of a fourth embodiment of this invention.
Figure 8:
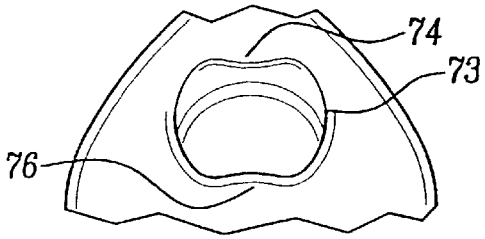
FIG. 8 is a view of FIG. 7 taken along and/or in the direction of arrow 8.

Referring now to FIGS. 7 and 8, there is shown a bottle assembly 70 made in accordance with the teachings of a fourth embodiment of the invention and comprising a bottle cap 22 and a bottle 72 having a integrally formed depression portion 73 (in one embodiment portion 73 is found in one of the side surfaces of the bottle at an angle of about 30° with respect to the longitudinal axis 20) and which includes annularly disposed and opposed shoulder portions 74 and 76. In the preferred embodiment of the invention, shoulders 74 and 76 are spaced apart by a distance slightly smaller or shorter than the diameter of bottle cap 22 thereby allowing for bottle cap 22 to frictionally fit within the formed depression by the cooperative depression of shoulders 74, 76. Assembly 72 differs from the previous assemblies 10, 50, and 60 by the use of the integrally formed depression 73 to selectively, removably, and frictionally engage and secure bottle cap 22 to the outside surface 77 of bottle 72 for storage. In all other aspects, assembly 70 is substantially similar to the other assemblies 10, 50, and 60.

Figure 10:
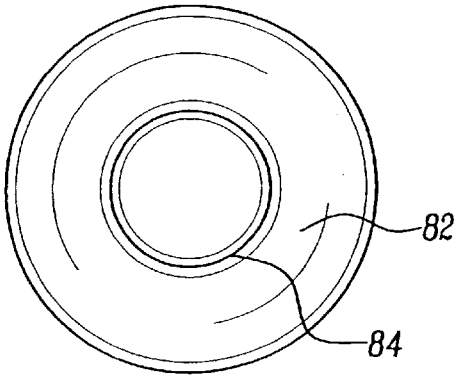
Figure 11:
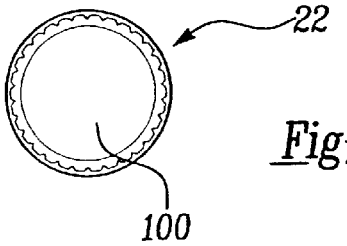
FIG. 11 is a side view of cap 22 taken in the direction of arrow 11.
Figure 9:
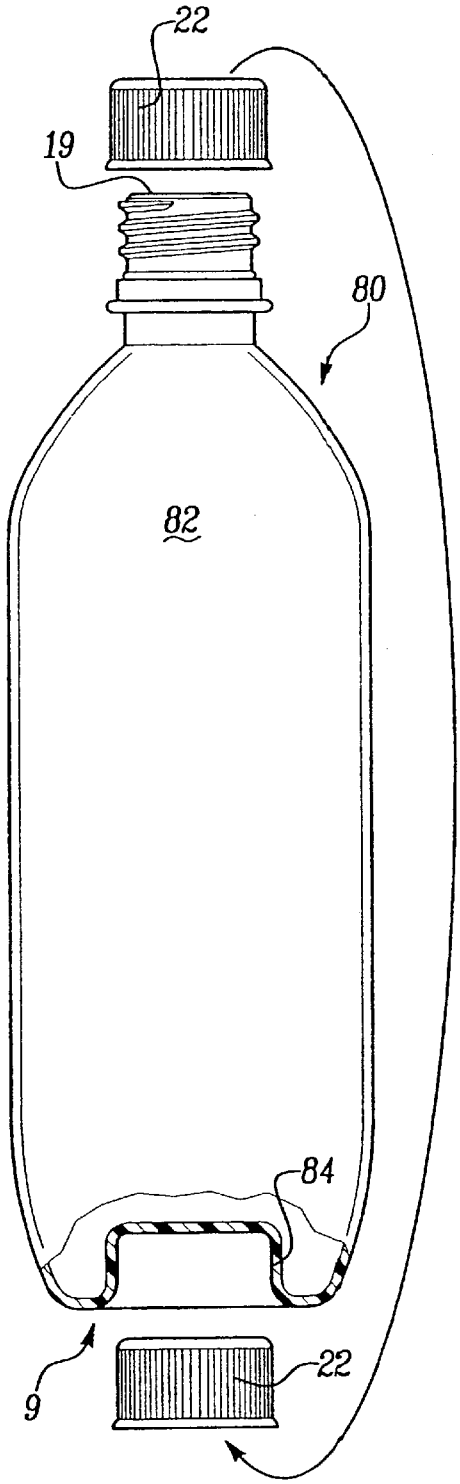
FIG. 9 is an assembled side view of a bottle assembly made in accordance with the teachings of a fifth embodiment of this invention.

Lastly, referring now to FIGS. 9 and 10, there is shown a bottle assembly 80 made in accordance with the teachings of a fifth embodiment of the invention and comprising a bottle cap 22 and a bottle 82 having an integrally formed depression 84 which is substantially similar in function and in shape to depression 73 of bottle 72 but which is distally and coaxially positioned with respect to portion 19 along longitudinal axis 20. In all other aspects assembly 80 is substantially similar to the other assemblies 10, 50, 60, and 70. It should be appreciated by those of ordinary skill in the art that cap 22 may be placed within depression 84 in a manner that causes top surface 100 to removable abut the bottle 80 or, alternatively, in a manner in which top surface 100 protrudes away from bottle 80.

It will be understood that the present invention is not limited to the exact construction or embodiment delineated above, but that it is contemplated that various changes and modifications may be made to the previously disclosed inventions without departing from the spirit and scope of the inventions and that nothing in this application was intended to limit the claimed inventions to the exact embodiments which have been previously described.

What is claimed is:

1. A bottle assembly comprising:

a cap having a generally cup shape outer surface and a hollow interior surface; and a bottle having a generally cylindrical outer surface and an interior beverage containment cavity, said bottle further having a first cap retention potion which is coaxial to a longitudinal axis of said generally cylindrical bottle and further having a second cap retention portion which protrudes from said generally cylindrical outer surface at an angle greater than zero degrees and less than one hundred and eighty degrees to said longitudinal axis and which is adapted to securely and removably fit within said hollow interior surface of said cap thereby allowing said cap to be selectively and removably attached to said second cap retention portion.

2. The bottle assembly in claim 1 wherein said angle is approximately thirty degrees.

* * * * *